US005167538A

United States Patent [19]

Stoerk

[11] Patent Number: 5,167,538

[45] Date of Patent: Dec. 1, 1992

[54] CONTACT COMPONENT

[75] Inventor: Peter Stoerk, Eurasburg, Fed. Rep. of Germany

[73] Assignee: Siemens Aktiengesellschaft, Munich, Fed. Rep. of Germany

[21] Appl. No.: 766,508

[22] Filed: Sep. 27, 1991

[30] Foreign Application Priority Data

Sep. 28, 1990 [DE] Fed. Rep. of Germany ..... 4030752

[51] Int. Cl.[5] ..... H01R 13/66

[52] U.S. Cl. ..... 439/620; 437/173

[58] Field of Search ..... 439/620, 166, 170, 171, 439/173, 174

[56] References Cited

U.S. PATENT DOCUMENTS 4,116,524 9/1978 DeNigris et al. ..... 439/620 X

FOREIGN PATENT DOCUMENTS 1665757 10/1971 Fed. Rep. of Germany .

2913901 10/1980 Fed. Rep. of Germany ..... 439/620

*Primary Examiner*—Eugene F. Desmond

*Attorney, Agent, or Firm*—Hill, Van Santen, Steadman & Simpson

[57] ABSTRACT

Contact component. Attached to a base part (5), the contact component (1) has a clamping adapter (3) and a fork spring contact (6) with which it can be plugged onto pin-shaped mating contacts (14, 15, 16). With respect to an axis of symmetry, proceeding in plug-in direction, of the fork spring contact to be contacted with the mating contact, an offset (v1 or v2) is provided for a clamping point (4) of the clamping adapter (3) in a first direction proceeding perpendicularly to the axis of symmetry and in a second direction proceeding perpendicularly to the first direction and to the axis of symmetry (2). Each contact component (1) is firmly inserted in various positions in a base housing part. This occurs in reception chambers which are provided in the shape of a grid at a certain dividing distance. The insertion in various positions of the contact components (1) provided with the offset enables the generation of contact configurations for the contact pins of electrical modular units or components which deviate from the arrangement of the reception chambers. For example, component contact pins arranged in one line can be converted to a mating contact arrangement aligned in a triangular shape. Generally, a conversion from a line to a grid is possible, or respectively, from a one grid to another grid with a different spacing. This feature also encompasses the expanding of two pin rows having a preset distance to two pin rows having a large distance from one another and vice versa.

13 Claims, 2 Drawing Sheets

CONTACT COMPONENT

BACKGROUND OF THE INVENTION

The present invention is directed to a contact component which, together with at least one other identical contact component at a pregiven grid-shaped dividing distance, is to be inserted in a base housing part of a first modular unit with a distance from one another as needed. The first modular unit plugs into a second modular unit having mating contacts in an arrangement spatially corresponding with the arrangement of the contact components in the first modular unit. The contact components of the first modular unit are also connected to attachment elements of electrical assemblies or components, which differ in their spacial arrangement relative to one another or in their position relative to the second modular unit from the arrangement of those contact components with which they are to be connected.

In electrical systems it is necessary to connect certain modular units with each other in a detachable fashion thereby necessitating electrical connections between them, or respectively, between the functional units respectively contained in them. One modular unit contains the contact components which are engaged with corresponding mating contact components of another modular unit in alignment therewith. It is usual, for example, to provide a modular unit with contact pins which are arranged with a certain spacing. The mating contacts of the other modular unit must then fulfill the function of a jack. These mating contacts are connected to attachment accessories of assemblies, or respectively, components contained in the modular unit. For these attachment accessories which are represented e.g. by wire-type contact pins, usually a certain connection configuration is preset. This preset configuration can deviate from the configuration of the contact components with which they are to be connected e.g. by soldering or clamping. In the event that such a deviation exists, a direct connection is only possible when additional measures are taken. This is particularly disadvantageous with regard to an automized mounting of such modular units. In order to compensate for such a deviation in the configuration of the contacts to be connected, an intermediate plane in the shape of an additional pc board can be used which has correspondingly adapted attachment accessories. Another solution is to deform the attachment accessories for alignment with their respectively appertaining contact points and possibly to provide correspondingly adjusted slide rail guides.

SUMMARY OF THE INVENTION

It is an object of the present invention to provide a flexible adaptation between parts to be connected for different configuration conditions.

This is achieved in that, with reference to the axis of symmetry of the connecting part and to the clamping point of the contact part, the axis of symmetry proceeding in a plug-in direction and the connecting part having to be contacted with the mating contact in an aligned fashion, a certain offset is established for the clamping point of the contact part provided for the connection with the attachment element. This offset is in a first direction proceeding perpendicularly to the axis of symmetry as well as in a second direction proceeding perpendicularly to the first direction and to the axis of symmetry. Each contact component can be firmly inserted in different positions in a base housing part given an unchanging plug-in direction so that based on the selection of the position of the inserted contact components relative to each other, the clamping points can be variably brought into a position that corresponds to the position of the attachment elements.

As a result the offset realized inventively in the contact component, which on the one hand has a clamping point, or respectively, connecting area for an attachment element and, on the other hand, a contact part for the plugged connection with a corresponding mating contact, a conversion from one configuration into a different configuration can be simply effected so that clamping points to be connected are brought into an aligned position. Only by selecting the position of completely identically fashioned contact components for which a certain adjustment to contact pin spacing thereof exists is a conversion from one configuration to a different configuration generally possible. Also a conversion is possible from a configuration aligned in a linear fashion to other non-linear configurations. Also with a simple dimensional adaptation in the predetermined offset to a contact pin spacing is a plurality of conversions possible due to the inventive contact component.

In a further development of the present invention the contact component is fashioned as one piece and has a rectangular or U-shaped base part which, in the plug-in direction towards the bottom, is fashioned as the connecting part to be contacted with the mating contact, and, in the plug-in direction towards the top, is fashioned as the contact part provided with offset for the clamping point.

Basically, the connecting part can be fashioned to receive a contact pin or a jack. The last mentioned function is achieved, for example, with the fashioning of the connecting part as a fork spring contact. Due to the U-shaped design of the base part, the base part can be easily inserted into a correspondingly adapted reception chamber of the base housing part designed for the respective modular unit in an anti-twist position. This can occur in positions rated against each other by respectively 90°.

According to a further development of the present invention, the contact part is designed as a clamping adapter. For its manufacturing, one exterior face of the base part extending towards the top is fashioned as an asymmetrically broadened projection, whose upper end region has a recess that has its position defined by the offset in the one direction. In the area of this recess, this end region is bent back so far on itself in acute-angled fashion that for the generation of a clamped connection with the recess, the attachment element, such as a contact pin, can be inserted between the legs formed by the bending backward and presses the lower edge of the bent back leg against the contact pin, thus enabling the clamped connection.

The clamping adapter of the contact component fashioned as one piece can thus be manufactured from a sheet spring of equal material thickness by simple punching-bending-events. For the guidance of the attachment element fashioned as a contact pin a bead is pressed into that leg of the connecting part that is not bent back so that particularly in the case of an automized mounting the alignment to the actual clamping point occurs.

According to a further development of the present invention, the clamping point of the contact part having the offset in two directions has a certain distance from the base part. This provides that, after the insertion of the contact component, the respective contact part is freely accessible in the area of the base part.

In a further embodiment of the present invention the first and second directions are determined by the alignment of edges of two side faces of the base part extending substantially perpendicularly into each other. In the second direction, the offset corresponds to the dimension or to a multiple thereof of the base part, and in the first direction, the offset corresponds to at least half of the dimension of the base part.

In a preferred embodiment the connecting part contacted with the mating contact is a fork spring contact having two contact legs residing against one another at least in partially resilient fashion, the contact legs being an extension of opposed side faces of the rectangular or U-shaped base part. For mutual contacting, the first modular unit containing the contact components is plugged onto the mating contacts of the second modular units that are in the same arrangement as the contact components in the first modular unit. The base housing part has reception chambers for receiving respective contact components and the contact component further has lateral projections in an area of the contact part and positioned transversely relative to an inserting direction. The lateral projections are inserted in incisions in the base housing part oriented in the insertion direction in an upper edge of each reception chamber and have a shape corresponding to the incisions. By means of corresponding blocking elements in the base housing part a displacement of the contact component opposite to the inserting direction is prevented. After insertion of the contact component in the reception chamber the contact part remains completely accessible above the lateral projections.

In one embodiment of the present invention the reception chambers are arranged in a triangular configuration relative to one another and with respect to the offsets of the clamping points of the contact parts. The contact components are inserted in a position rotated relative to one another such that the clamping points of the contact parts have an aligned position so that the attachment elements of the electrical assemblies or components aligned in a plane of a longitudinal center axis can be plugged directly into the contact part.

BRIEF DESCRIPTION OF THE DRAWINGS

The features of the present invention which are believed to be novel, are set forth with particularity in the appended claims. The invention, together with further objects and advantages, may best be understood by reference to the following description taken in conjunction with the accompanying drawings, in the several Figures in which like reference numerals identify like elements, and in which:

DESCRIPTION OF THE PREFERRED EMBODIMENT

Figure 1:
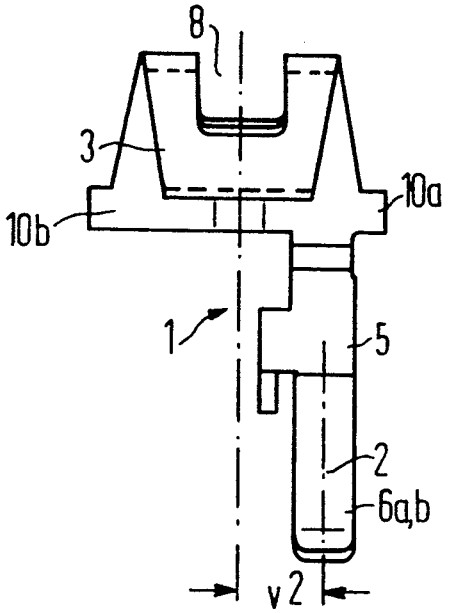
FIGS. 1 to 3 are top, side and end views of the contact component according to the present invention.
Figure 2:
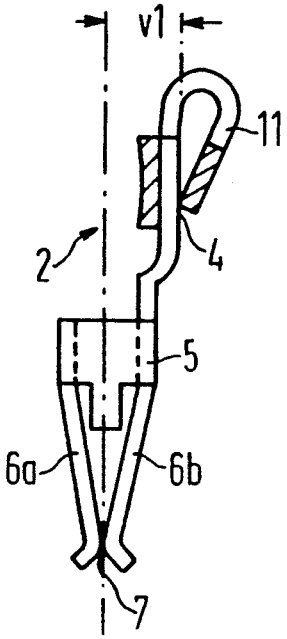
Figure 3:
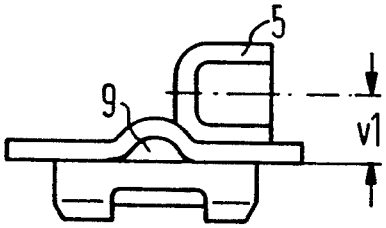

FIGS. 1 to 3 depict an exemplary embodiment of the contact element, based on a U-shaped base part, that has a contact part fashioned as a clamping adapter 3 on one end and, on the other end not facing this one has a fork spring contact by means of which the contact component 1 can be plugged onto a contact pin that serves as a mating contact. The legs 6*a* and 6*b* of the fork spring contact which are a direct extension of the oppositely residing side walls of the base part 5 come together and constitute the contact location 7.

The contact part in the shape of the clamping adapter 3 generated by an upward continuation of the base part 5 is formed by this part being bent back on itself. In the bending area, a recess 8 is provided, which previously was an oblong hole, through which a contact element fashioned as a contact pin, for example, can be inserted between the branches generated by the bending. For better guidance of such a contact pin a bead 9 is provided whereby the depth of a resulting guiding groove generated by the lead 9 is less than the diameter of the respective contact pin. With respect to the axis of symmetry 2 of the fork spring contact, the actual clamping point 4 of the clamping adapter 3 is offset in two directions perpendicularly to one another by the respective distance values v1, v2. From the upper limiting edges of the base part 5, the actual clamping point 4 has a certain distance as disclosed in FIGS. 1 or 2. This ensures that, after the insertion of the contact component 1 in a reception chamber correspondingly adapted to its base part 5, the clamping adapter 3 remains accessible. With the ridge 10*a*, 10*b* which is inserted e.g. in an incision correspondingly adapted thereto when the insertion takes place, the component can support itself in a plug-in direction. With respect to this direction, this incision is respectively located at the upper edge of the chamber walls.

The respective reception chambers are located in a base housing part of a modular unit which then contains those assemblies or components whose contact elements e.g. fashioned as contact pins must be connected via the clamping adapter with the contact component in a prearranged allocation. The contact pins provided on an assembly or on a component have a certain spacial configuration relative to one another. Usually, this configuration does not correspond with that configuration which is stipulated for the contact pins that are predetermined as mating contacts, e.g. for certain constructive reasons. For the generation of the plugged connection between this modular unit and the first mentioned modular unit, however, the parts enabling such a connection, i.e. in the exemplary embodiment the contact pins and the fork spring contacts, are in true alignment with each other.

In FIGS. 4*a*–4*f* some basic possibilities are schematically depicted whereby due to the inventive contact component 1 a defined geometry of the cited contact pins ca be converted into a geometry of the mating contacts for the contact component deviating therefrom. This means that the function of a conversion plug from contact configurations to pin grids, for example, can be realized. With that, it is possible in the case of, for example, end plugs, short-circuit bridges and other devices, to provide a direct adaptation of the contact pins of their components contained therein to the plug-in contacts e.g. fashioned as fork spring contacts occurs.

FIG. 4 only exemplifies a few conversion possibilities. Depending on the conditions of the respective application case, the contact elements are to be inserted in various positions in the reception chambers of a base plate, for which again a certain grid is provided in the spacial allocation of these reception chambers among each other. In the examples of FIG. 4*a*, the position of the contact pins of assemblies or components is symbolically characterized by a small circle, and the position of the mating contacts likewise determined by the design, and thus correspondingly the position of the contact locations by an X. Moreover, at least for the FIGS. 4*a*–4*f* presentations, the respective position of the inserted contact components is symbolically depicted in correspondence with the FIG. 3 view.

Figure 4A:
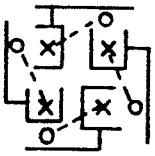
FIGS. 4*a*–4*f* schematically depict different possibilities in the conversion of contact element configurations to a mating different contact configuration.

In the representation according to FIG. 4*a*, an adaptation of a grid defined by four contact pins to a different mating contact grid is performed. The individual inventive contact components are inserted in alternating fashion respectively rotated relative to one another by 90°. In the configuration shown in FIG. 4*b*, contact pins which are arranged in a straight line at a certain distance from one another are converted to a grid arrangement for the mating contacts. The contact elements are thereby inserted rotated relative to one another by 180°. Referring now to the three lowest contact elements for example, a transformation from a linear arrangement to a triangular arrangement is performed, whereby the mating contacts or respectively, the contact elements of the contact component 1 are arranged at the corner points of this triangle.

Figure 4B:
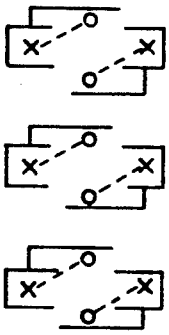
Figure 4C:
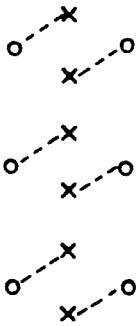

In a similar manner, it is then possible according to FIG. 4*c* to perform an adaptation of mating contacts which are arranged in a line, to the contact pins arranged in the specified grid. The contact components are inserted in a line in alternating fashion relative to one another by 180°.

Figure 4D:
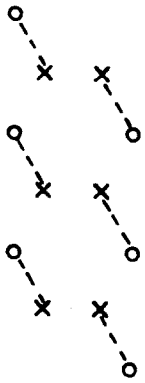

The symbolic representation of FIG. 4*d* shows that two rows of contact pins are to be adapted to two rows of mating contact rows having a lesser distance among themselves. The contact components can be inserted within one mating contact row in the same position, whereby the contact components of the one row are rotated by 180° compared to the other row.

Figure 4E:
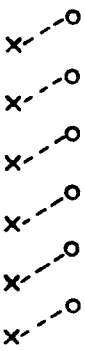
Figure 4F:
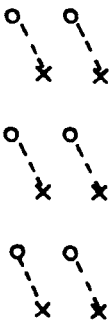
Figure 5:
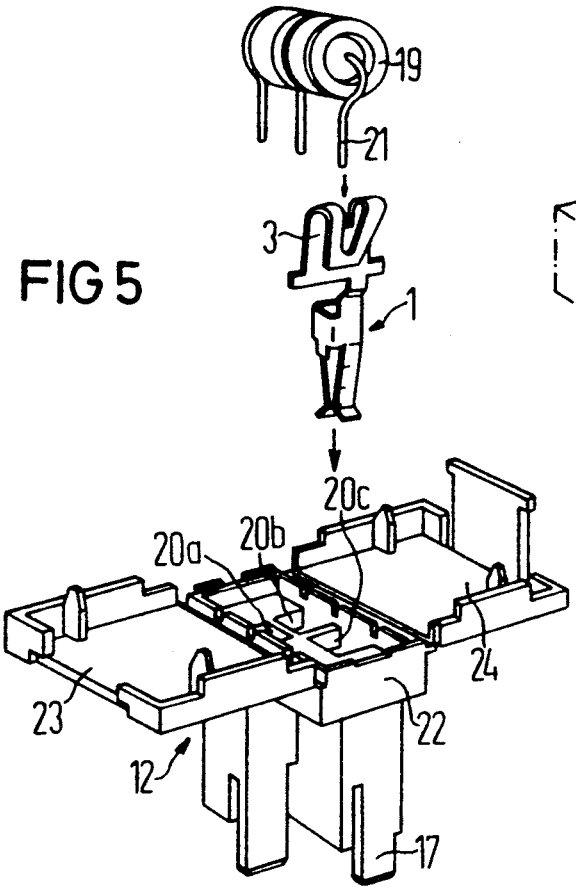
FIGS. 5 to 8 depict details of the application of the contact component according to the present invention in the embodiment of a protective plug which can be plugged on a distributor ledge having the respective mating contacts.

In FIG. 4*e* one row of linearly aligned contact pins is to be adapted to another row of mating contacts aligned in the same way in linear fashion. FIG. 4*f* shows a different configuration of two rows of contact pins and two rows of mating contacts.

Figure 6:
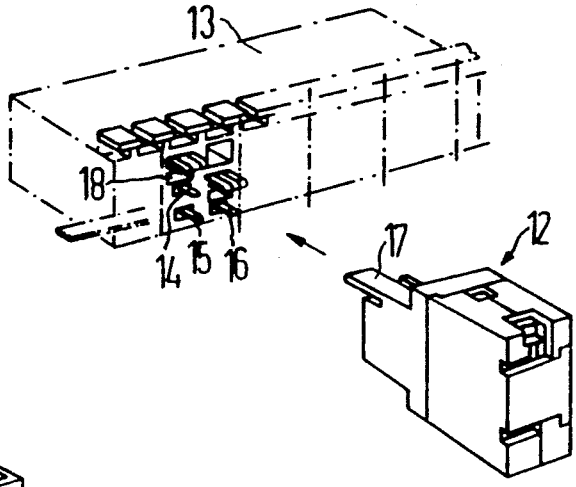

From a certain positioning of the inventive contact component result more conversion possibilities than the ones shown. In the FIGS. 5 to 8, the application of the inventive contact component 1 in the case of a protective plug 12 is depicted. Such a protective plug is necessary for example for a distributor ridge in order to deduct overvoltage on wire leads or cable strands that are through connected via the distributor ridge. Given the requirement of a separate protective plug 12 for a wire lead pair, a contacting possibility to each of the two leads and to a ground connection is necessary for this protective plug. In the perspective view according to FIG. 6, those are the contact pins 14, 1 5, 16, which project out of the distributor ridge 13 on a control side. For constructive and other reasons that result from the parts used for the structure of the ridge, these contact pins or contact knives are allocated to each other on the control side such that they reside on the corner points of a triangle. Two of the three contact pins constituting this triangle configuration are placed in direct proximity of one outside edge of the ridge.

In this case, one of the two units to be plugged together thus represents a distributor ridge whereas the other modular unit constitutes the protective plug. In order to enable this plugged connection directly, the contact parts to be contacted with the contact pins 14, 15, 16 are inserted in equal allocation to one another in the protective plug. This means that the reception chambers for the respective contact components indicated in the exploded view of the protective plug in FIG. 5 have the same configuration relative to one another as the contact pins 14, 15, 16. This means, regarding their contact parts (fork spring contact) to be contacted with the contact pins the reception chambers or the contact elements are placed in the same triangle shape. The contact pins 21 of a surge diverter 29 that are to be connected with the contact components 1 reside in a straight line in a longitudinal direction of the surge diverter 19. When normal contact elements are used i.e. those not fashioned according to the present invention and whereby the clamping point usually lies in the axis of symmetry of the contact parts to be plugged together, a corresponding deformation of the contact pins 21 would have to be performed for the adaptation. This is not necessary when the contact component 1 of the present invention is used.

Figure 7:
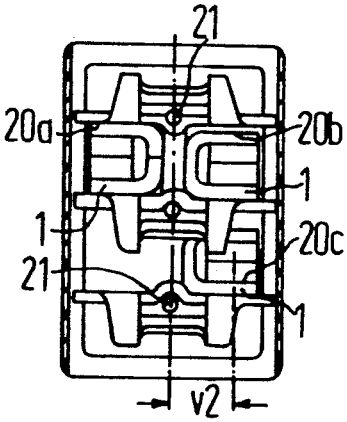
Figure 8:
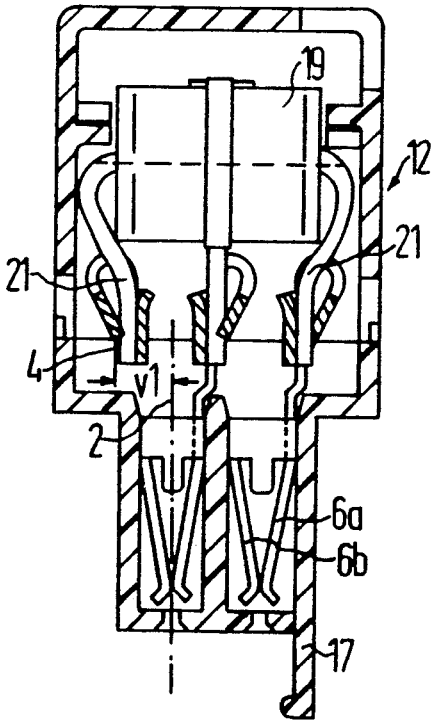

In an enlarged scale, FIGS. 7 and 8 show two cross-sections of the protective plug 1 ready for use. The clamping point 4 of the contact part 3 is, as mentioned earlier, offset by the distance values v1, v2 in two alignments perpendicular to each other with respect to the center axis 2 of the fork spring contact 6*a*, 6*b*. This special design allows insertion of these completely equal contact components in the reception chambers 20*a*, 20*b*, 20*c*, and thus to provide clamping points which are arranged in a straight line, although the reception chambers themselves are positioned approximately at the corner points of a triangle shape. As revealed by the cross-section according to FIG. 7, a contact component 1 is inserted in each of the reception chambers 20*b* and 20*c* in a corresponding alignment. The contact component 1 inserted in the reception chamber 20*a* accordingly is rotated in its position by 180° compared to the contact components in reception chambers 20*b* and 20*c*. Thus, the clamping points for the contact pins 21 of the surge diverter 19 lie in a straight line, although one reception chamber is arranged laterally offset compared to the others. This means a conversion takes place of the mating contact locations residing on the corner points of a triangle shape to a linear arrangement of the contact pins 21. This corresponds to a configuration conversion as depicted in FIG. 4*b*.

Thus, it is possible to use a commercially available surge diverter without additional modifications in the alignment of its contact pins 21 for the protective plug. This is of particular advantage for an automized mounting of such a protective plug. In the case of such a mounting, the two upper parts 23, 24 shown in FIG. 5 which are connected with the upper outside edges of the base housing part 22 e.g. in the manner of a film hinge, are turned to face each other and mechanically connected with each other by a provided arresting means to the closed housing for the protective plug. When the protective plug 1 is seated on the mating contact pins 14, 15, 16, the pin 17 located at the base housing part 22 are inserted in corresponding openings 18. As a result, an undesired detachment of the pluggedon protective plug can be prevented. The nub present at the bottom edge of the projection 17 according to FIG. 8 engages behind a corresponding projection in the distributor ridge when the insertion takes place. FIG. 8 reveals furthermore that in the case of this embodiment of the protective plug, the fork spring contacts of the inventive contact component 1 are arranged in the base housing part 22 in a completely protected fashion.

The invention is not limited to the particular details of the apparatus depicted and other modifications and applications are contemplated. Certain other changes may be made in the above described apparatus without departing from the true spirit and scope of the invention herein involved. It is intended, therefore, that the subject matter in the above depiction shall be interpreted as illustrative and not in a limiting sense.

What is claimed is:

1. A contact component for insertion in a base housing part of a first modular unit at a predetermined grid-shaped spacing from at least one other substantially identical contact component, such that the contact components of the first modular unit can be plugged together with respective mating contacts of a second modular unit, the mating contacts having a predetermined spacial arrangement, the contact components also connected to respective attachment elements of electrical assemblies or components, the attachment elements having a spacial arrangement different from the predetermined spacial arrangement of the mating contacts, comprising:

a contact part having a clamping point for engaging a respective attachment element of the electrical assemblies or components;

a connecting part for engaging a respective mating contact of the second modular unit;

with reference to an axis of symmetry of the connecting part the axis of symmetry proceeding in a plug-in direction and the connecting part being aligned for contacting a respective mating contact, the clamping point of the contact part provided for connection with a respective attachment element, having a predetermined offset in a first direction proceeding perpendicularly to the axis of symmetry and in a second direction proceeding perpendicularly both to the first direction and to the axis of symmetry; and each contact component being firmly inserted in one of a plurality of different positions in the base housing part for a set plug-in direction so that based on a selection of the position of the inserted contact components relative to each other, the clamping points are in a position that corresponds to the position of the respective attachment element, the base housing part having reception chambers for acceptance of the contact component, the reception chambers being dimensionally adapted to the base part of the contact component, and into which the base part is firmly inserted in various positions, each position being a rotation of the contact component by 90°.

2. The contact component according to claim 1, wherein the reception chambers are arranged in a triangular configuration relative to one another and with respect to the offsets of the clamping points of respective contact parts, the contact components being inserted in a position rotated relative to one another such that the clamping points of the contact parts have an aligned position so that the attachment elements of the electrical assemblies or components aligned in a plane of a longitudinal center axis can be plugged directly into the contact part.

3. A contact component for insertion in a base housing part of a first modular unit at a predetermined grid-shaped spacing from at least one other substantially identical contact component, such that the contact components of the first modular unit can be plugged together with respective mating contacts of a second modular unit, the mating contacts having a predetermined spacial arrangement, the contact components also connected to respective attachment elements of electrical assemblies or components, the attachment elements having a spacial arrangement different from the predetermined spacial arrangement of the mating contacts, comprising:

a contact part having a clamping point for engaging a respective attachment element of the electrical assemblies or components;

a connecting part for engaging a respective mating contact of the second modular unit;

with reference to an axis of symmetry of the connecting part the axis of symmetry proceeding in a plug-in direction and the connecting part being aligned for contacting a respective mating contact, the clamping point of the contact part provided for connection with a respective attachment element, having a predetermined offset in a first direction proceeding perpendicularly to the axis of symmetry and in a second direction proceeding perpendicularly both to the first direction and to the axis of symmetry;

each contact component being firmly inserted in one of a plurality of different positions in the base housing part for a set plug-in direction so that based on a selection of the position of the inserted contact components relative to each other, the clamping points are in a position that corresponds to the position of the respective attachment element;

the contact component being one piece and having a substantially rectangular or U-shaped base part which, in the plug-in direction towards a bottom of the contact component, is formed as the connecting part to be contacted with the mating contact, and, in the plug-in direction towards a top of the contact component, is formed as the contact part provided with the offset for the clamping point; and the contact part being a clamping adapter, one exterior face of the base part extending towards the top being formed as an asymmetrically broadened projection with an upper end region having a recess having a position defined by the offset in the second direction, in an area of the recess the upper end region being bent back so far on itself at an acute angle that for the generation of a clamped connection with the recess the attachment element can be inserted between branches formed by the bending backward and presses a lower edge of the bent back branches against the attachment element and thus enables a clamped connection.

4. The contact component according to claim 3, wherein the attachment element is a contact pin and wherein a portion of the contact part not bent back has a bead which guides the contact pin in the direction of the clamping point and whose depth is less than a diameter of the contact pin.

5. The contact component according to claim 3, wherein in the second direction, the offset corresponds to the dimension or to a multiple thereof of the base part, and wherein in the first direction, the offset corresponds to at least half of the dimension of the base part.

6. A contact component for insertion in a base housing part of a first modular unit at a predetermined grid-shaped spacing from at least one other substantially identical contact component, such that the contact components of the first modular unit can be plugged together with respective mating contacts of a second modular unit, the mating contacts having a predetermined spacial arrangement, the contact components also connected to respective attachment elements of electrical assemblies or components, the attachment elements having a spacial arrangement different from the predetermined spacial arrangement of the mating contacts, comprising:

a contact part having a clamping point for engaging a respective attachment element of the electrical assemblies or components;

a connecting part for engaging a respective mating contact of the second modular unit;

with reference to an axis of symmetry of the connecting part the axis of symmetry proceeding in a plug-in direction and the connecting part being aligned for contacting a respective mating contact, the clamping point of the contact part provided for connection with a respective attachment element, having a predetermined offset in a first direction proceeding perpendicularly to the axis of symmetry and in a second direction proceeding perpendicularly both to the first direction and to the axis of symmetry;

each contact component being firmly inserted in one of a plurality of different positions in the base housing part for a set plug-in direction so that based on a selection of the position of the inserted contact components relative to each other, the clamping points are in a position that corresponds to the position of the respective attachment element;

the contact component being one piece and having a substantially rectangular or U-shaped base part which, in the plug-in direction towards a bottom of the contact component, is formed as the connecting part to be contacted with the mating contact, and, in the plug-in direction towards a top of the contact component, is formed as the contact part provided with the offset for the clamping point;

the connecting part contacted with the mating contact being a fork spring contact having two contact legs residing against one another at least in partially resilient fashion, the contact legs being an extension of opposed side faces of the rectangular or U-shaped base part;

for mutual contacting, the first modular unit containing the contact components being plugged onto the mating contacts of the second modular units that are in the same arrangement as the contact components in the first modular unit; and the base housing part having reception chambers for receiving respective contact components and the contact component further comprising lateral projections in an area of the contact part and positioned transversely relative to an inserting direction, the lateral projections being inserted in incisions in the base housing part oriented in the insertion direction in an upper edge of each reception chamber and having a shape corresponding to the incisions, and via corresponding blocking elements in the base housing part a displacement of the contact component opposite to the inserting direction being prevented.

7. The contact component according to claim 6, wherein after insertion of the contact component in the reception chamber the contact part remains completely accessible above the lateral projections.

8. A contact component for insertion in a base housing part of a first modular unit at a predetermined grid-shaped spacing from at least one other substantially identical contact component, such that the contact components of the first modular unit can be plugged together with respective mating contacts of a second modular unit, the mating contacts having a predetermined spacial arrangement, the contact components also connected to respective attachment elements of electrical assemblies or components, the attachment elements having a spacial arrangement different from the predetermined spacial arrangement of the mating contacts, comprising:

a contact part having a clamping point for engaging a respective attachment element of the electrical assemblies or components;

a connecting part for engaging a respective mating contact of the second modular unit;

a substantially rectangular or U-shaped base part which, in the plug-in direction towards a bottom of the contact component is formed as the connecting part to be contacted with the mating contact, the connecting part being a fork spring contact having two contact legs residing against one another at least in partially resilient fashion, the contact legs being an extension of opposed side faces of the rectangular or U-shaped base part, and, in the plug-in direction towards a top of the contact component, is formed as the contact part for the clamping point;

with reference to an axis of symmetry of the connecting part the axis of symmetry proceeding in a plug-in direction and the connecting part being aligned for contacting a respective mating contact, the clamping point of the contact part provided for connection with a respective attachment element, having a predetermined offset in a first direction proceeding perpendicularly to the axis of symmetry and in a second direction proceeding perpendicularly both to the first direction and to the axis of symmetry;

each contact component being firmly inserted in one of a plurality of different positions in the base housing part for a set plug-in direction so that based on a selection of the position of the inserted contact components relative to each other, the clamping points are in a position that corresponds to the position of the respective attachment element; and the first modular unit having reception chambers for acceptance of the contact component in the base housing part, the reception chambers being dimensionally adapted to the base part of the contact component, and into which the base part is firmly inserted in various positions, each position being a rotation of the contact component by 90°.

9. A contact component for insertion in a base housing part of a first modular unit at a predetermined grid-shaped spacing from at least one other substantially identical contact component, such that the contact components of the first modular unit can be plugged together with respective mating contacts of a second modular unit, the mating contacts having a predetermined spacial arrangement, the contact components also connected to respective attachment elements of electrical assemblies or components, the attachment elements having a spacial arrangement different from the predetermined spacial arrangement of the mating contacts, comprising:

a contact part having a clamping point for engaging a respective attachment element of the electrical assemblies or components;

a connecting part for engaging a respective mating contact of the second modular unit;

a substantially rectangular or U-shaped base part which, in the plug-in direction towards a bottom of the contact component is formed as the connecting part to be contacted with the mating contact, the connecting part being a fork spring contact having two contact legs residing against one another at least in partially resilient fashion, the contact legs being an extension of opposed side faces of the rectangular or U-shaped base part, and, in the plug-in direction towards a top of the contact component, is formed as the contact part for the clamping point;

with reference to an axis of symmetry of the connecting part the axis of symmetry proceeding in a plug-in direction and the connecting part being aligned for contacting a respective mating contact, the clamping point of the contact part provided for connection with a respective attachment element, having a predetermined offset in a first direction proceeding perpendicularly to the axis of symmetry and in a second direction proceeding perpendicularly both to the first direction and to the axis if symmetry;

each contact component being firmly inserted in one of a plurality of different positions in the base housing part for a set plug-in direction so that based on a selection of the position of the inserted contact components relative to each other, the clamping points are in a position that corresponds to the position of the respective attachment element; and the contact part being a clamping adapter, one exterior face of the base part extending towards the top being formed as an asymmetrically broadened projection with an upper end region having a recess having a position defined by the offset in the second direction, in an area of the recess the upper end region being bent back so far on itself at an acute angle that for the generation of a clamped connection with the recess the attachment element can be inserted between branches formed by the bending backward and presses a lower edge of the bent back branches against the attachment element and thus enables a clamped connection.

10. A contact component for insertion in a base housing part of a first modular unit at a predetermined grid-shaped spacing from at least one other substantially identical contact component, such that the contact components of the first modular unit can be plugged together with respective mating contacts of a second modular unit, the mating contacts having a predetermined spacial arrangement, the contact components also connected to respective attachment elements of electrical assemblies or components, the attachment elements having a spacial arrangement different from the predetermined spacial arrangement of the mating contacts, comprising:

a contact part having a clamping point for engaging a respective attachment element of the electrical assemblies or components;

a connecting part for engaging a respective mating contact of the second modular unit;

a substantially rectangular or U-shaped base part which, in the plug-in direction towards a bottom of the contact component is formed as the connecting part to be contacted with the mating contact, and, in the plug-in direction towards a top of the contact component, is formed as the contact part provided with an offset for the clamping point;

with reference to an axis of symmetry of the connecting part the axis of symmetry proceeding in a plug-in direction and the connecting part being aligned for contacting a respective mating contact, the clamping point of the contact part provided for connection with a respective attachment element, having a predetermined offset in a first direction proceeding perpendicularly to the axis of symmetry and in a second direction proceeding perpendicularly both to the first direction and to the axis of symmetry; and each contact component being firmly inserted in one of a plurality of different positions in the base housing part for a set plug-in direction so that based on a selection of the position of the inserted contact components relative to each other, the clamping points are in a position that corresponds to the position of the respective attachment element, the first modular unit having reception chambers for acceptance of the contact component in the base housing part, the reception chambers being dimensionally adapted to the base part of the contact component, and into which the base part is firmly inserted in various positions, each position being a rotation of the contact component by 90°.

11. The contact component according to claim 10, wherein the contact part is a clamping adapter, wherein one exterior face of the base part extending towards the top is formed as an asymmetrically broadened projection with an upper end region having a recess having a position defined by the offset in the second direction, wherein in an area of the recess the upper end region is bent back so far on itself at an acute angle that for the generation of a clamped connection with the recess the attachment element can be inserted between branches formed by the bending backward and presses a lower edge of the bent back branches against the attachment element and thus enables a clamped connection.

12. The contact component according to claim 10, wherein the attachment element is a contact pin and wherein a portion of the contact part not bent back has a bead which guides the contact pin in the direction of the clamping point and whose depth is less than a diameter of the contact pin.

13. The contact component according to claim 10, wherein the connecting part contacted with the mating contact is a fork spring contact having two contact legs residing against one another at least in partially resilient fashion, the contact legs being an extension of opposed side faces of the rectangular or U-shaped base part.

* * * * *